US010071589B2

(12) United States Patent
Mauzy

(10) Patent No.: US 10,071,589 B2
(45) Date of Patent: Sep. 11, 2018

(54) SADDLE STITCH BOOKS AND METHODS OF PRODUCING THE SAME

(71) Applicant: R.R. Donnelley & Sons Company, Chicago, IL (US)

(72) Inventor: Duane Mauzy, Holts Summit, MO (US)

(73) Assignee: LSC Communications US, LLC, Chicago, IL (US)

( * ) Notice: Subject to any disclaimer, the term of this patent is extended or adjusted under 35 U.S.C. 154(b) by 287 days.

(21) Appl. No.: 14/567,286

(22) Filed: Dec. 11, 2014

(65) Prior Publication Data

US 2015/0183256 A1 Jul. 2, 2015

Related U.S. Application Data

(60) Provisional application No. 61/921,776, filed on Dec. 30, 2013.

(51) Int. Cl.

| | |
|---|---|
| ***B42D 1/00*** | (2006.01) |
| ***B42D 5/00*** | (2006.01) |
| ***B42C 9/00*** | (2006.01) |
| ***B42C 13/00*** | (2006.01) |
| ***B42C 11/02*** | (2006.01) |
| ***B42B 9/00*** | (2006.01) |
| ***B42C 11/04*** | (2006.01) |
| ***B42B 5/00*** | (2006.01) |
| ***B42B 2/00*** | (2006.01) |
| ***B42B 5/08*** | (2006.01) |
| ***B42C 19/04*** | (2006.01) |

(52) U.S. Cl.

CPC ..... *B42C 9/0081* (2013.01); *B42C 19/04* (2013.01)

(58) Field of Classification Search

CPC ..... B42C 9/0081; B42C 19/04

USPC ..... 281/3.1, 15.1, 21.1, 27; 412/9, 11, 14, 412/19, 20, 21, 25, 30, 33, 35, 37, 38, 412/901

See application file for complete search history.

(56) References Cited

U.S. PATENT DOCUMENTS

| | | | | |
|---|---|---|---|---|
| 5,437,476 | A * | 8/1995 | Hutchinson | B42D 1/00 281/12 |
| 6,099,225 | A * | 8/2000 | Allen | B41F 17/02 412/1 |
| 2007/0272361 | A1* | 11/2007 | Cracknell | B42C 1/12 156/578 |
| 2008/0199276 | A1* | 8/2008 | Graushar | B42C 11/00 412/4 |

(Continued)

*Primary Examiner* — Justin V Lewis

(74) *Attorney, Agent, or Firm* — Hanley, Flight and Zimmerman, LLC

(57) ABSTRACT

Systems and methods are disclosed to produce a books in which interior staples are hidden. One disclosed example apparatus includes a sensor to detect a position of a book being produced on a binding line. The example book includes signatures coupled by a fastener. The fastener separates a first signature portion from a second signature portion of a first signature. The example apparatus also includes an adhesive dispenser to dispense adhesive to at least one of on or adjacent the fastener to couple the first signature portion and the second signature portion along a first fold adjacent the fastener. The example apparatus also includes a controller to cause the adhesive dispenser to dispense adhesive based on the position of the book detected by the sensor.

22 Claims, 7 Drawing Sheets

(56) References Cited

U.S. PATENT DOCUMENTS

| | | | | |
|---|---|---|---|---|
| 2009/0087283 | A1* | 4/2009 | Willauer | B42C 9/0081 412/8 |
| 2009/0263226 | A1* | 10/2009 | Ramsey | B42C 19/04 414/788.1 |
| 2010/0074713 | A1* | 3/2010 | Wicki | B42C 9/0037 412/4 |
| 2012/0321414 | A1* | 12/2012 | Watanabe | B65H 45/12 412/25 |

* cited by examiner

SADDLE STITCH BOOKS AND METHODS OF PRODUCING THE SAME

RELATED APPLICATION

This application claims the benefit under 35 U.S.C. § 119(e) to U.S. Provisional Application 61/921,776 titled "SADDLE STITCH BOOKS AND METHODS OF PRODUCING THE SAME," filed Dec. 30, 2013, which is incorporated herein by this reference in its entirety.

FIELD OF THE DISCLOSURE

This patent relates generally to saddle stitch books and, more particularly, to saddle stitch books and methods of producing the same.

BACKGROUND

Saddle stitch books are commonly produced by stacking and stapling signatures together such that staples are exposed along an interior fold line of the book when opened.

BRIEF DESCRIPTION OF THE DRAWINGS

The figures are not to scale. Instead, to clarify multiple layers and regions, the thicknesses of the layers may be enlarged in the drawings. Wherever possible, the same reference numbers will be used throughout the drawing(s) and accompanying written description to refer to the same or like parts.

DETAILED DESCRIPTION

Figure 1:
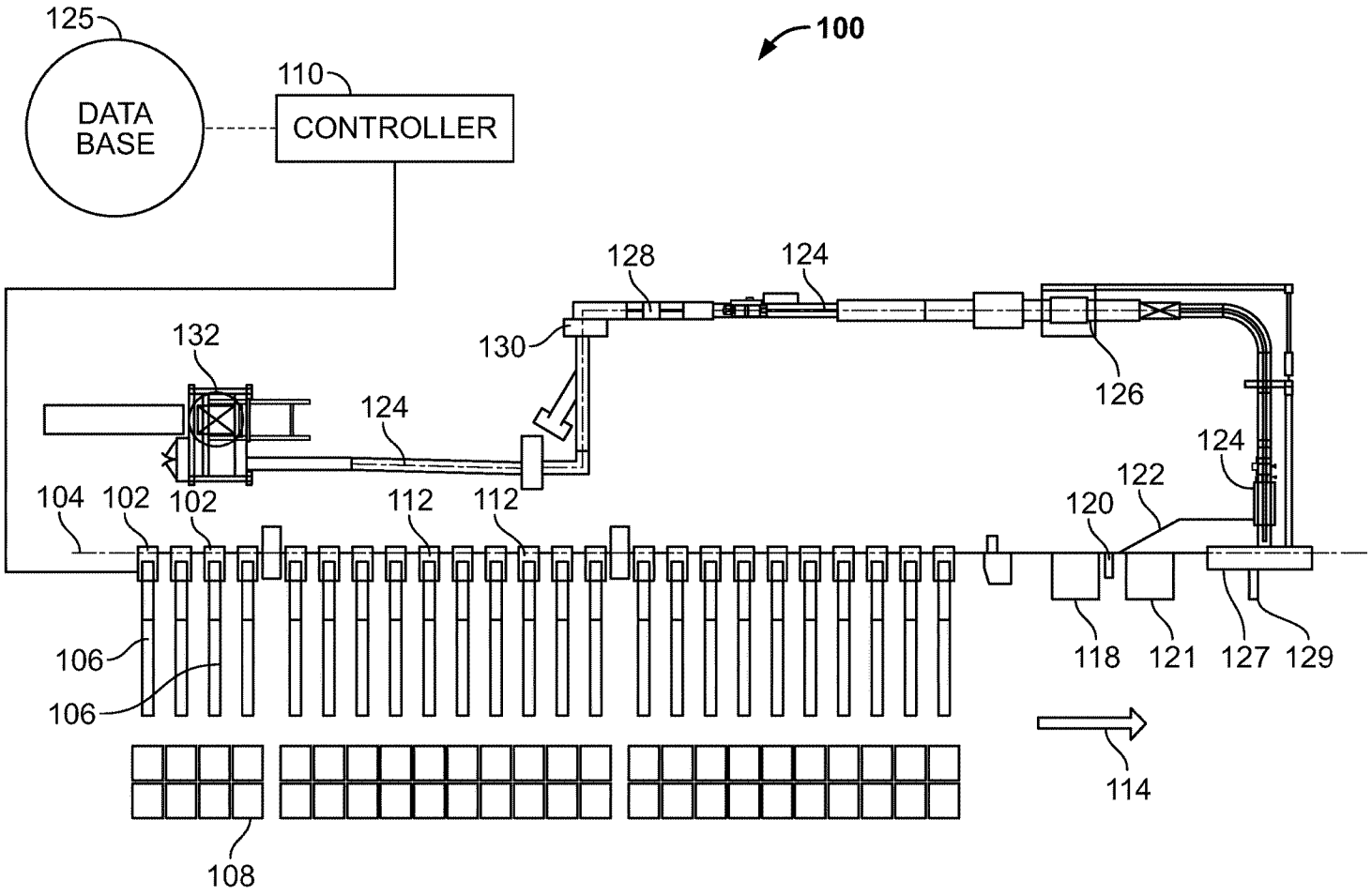
FIG. 1 is a schematic illustration of an example binding line that can be used to produce the example books disclosed herein.

The examples disclosed herein relate to saddle stitch books in which staple ends used to bind these books are substantially non-exposed and/or non-accessible. In contrast to the examples disclosed herein, traditional saddle stitch books have exposed and/or accessible staples which, in some examples, cause these books not to pass certain quality standards. The example books disclosed herein pass quality standards because internal pages of the example books are coupled together such that the ends of the staples are positioned between the coupled pages, and the staple ends remain non-exposed and/or non-accessible even if the book is opened at its center.

To produce the example saddle stitch books in accordance with the teachings of this disclosure, signatures are stacked, aligned and stapled together on a binding line. After the signatures are stapled together, in some examples, the books move along a conveyor toward an example adhesive station having a sensor, a controller and/or an adhesive dispenser. The sensor may be used to detect a position of the book (e.g., a leading edge and/or a trailing edge of the book) as the book moves past the sensor on the conveyor.

To cause the adhesive dispenser to dispense adhesive to an interior portion of the book proximate the staples and along a center fold of the book, in some examples, the controller uses positional data from the sensor, a rate of travel and/or a distance of travel of the conveyor from an encoder (e.g., a pulse encoder). The controller may periodically or continually receive information from the sensor/encoder. The dispensed adhesive couples two portions of a central or first signature of the book together encapsulating the staple ends and, thus, prevents the staple ends from being exposed even if the book is opened at its center. In addition, some example adhesive stations or binding lines disclosed herein include one or more rollers (e.g., opposing rollers) through which the book passes to urge the opposing signature portions together to cause the dispensed adhesive to couple the two portions of the books.

One disclosed example apparatus includes a sensor to detect a position of a book being produced on a binding line. The book includes signatures coupled by a fastener. The fastener separates a first signature portion from a second signature portion of a first signature. An adhesive dispenser dispenses adhesive to on and/or an interior of the book adjacent the fastener to couple the first signature portion and the second signature portion along a first fold adjacent the fastener. The example apparatus also includes a controller to cause the adhesive dispenser to dispense adhesive based on the position of the book detected by the sensor.

In some examples, the example apparatus also includes a folder to form a second fold on the first signature portion and a third fold on the second signature portion, and at least a portion of the fastener is to be disposed between the second fold and the third fold. In some examples, the second fold is to be brought into engagement with the third fold.

In some examples, the example apparatus also includes a second sensor to measure at least one of a rate of travel of the conveyor or a distance of travel of the conveyor and to convey at least one of the rate of travel or the distance of travel to the controller. In some examples, the controller of the example apparatus determines the position of the book based on at least one of the rate of travel or the distance of travel. In some examples, the example apparatus also includes a second sensor to detect a presence or an absence of a fastener in a second book, wherein the controller is to hold adhesive from the second book based on a detected absence. In some examples, the first sensor of the example apparatus detects a first leading edge and a first trailing edge of a first book and a second leading edge and a second trailing edge of a second book. A first distance between the first leading and trailing edges is different from a second distance between the second leading and trailing edges. In some examples, the controller of the example apparatus may cause the adhesive dispenser to dispense adhesive to the first book and the second book based on the first and second distances and the respective first and second leading and trailing edges. In some examples, the adhesive dispenser of the example apparatus atomizes the dispensed adhesive. In some examples, the first sensor of the example apparatus detects a leading edge and a trailing edge of the book and the controller is to cause the adhesive dispenser to dispense adhesive between the leading edge and the trailing edge.

In some examples, the controller is to dispense adhesive between a first distance from the leading edge and a second distance from the trailing edge to prevent the adhesive from flowing out of the book when the book passes through rollers after the book receives the adhesive. In some examples, the adhesive dispenser of the example apparatus also includes an adjuster to change at least one of a rate of adhesive dispensed, a width of the adhesive dispensed, or an amount of adhesive dispensed. In some examples, the example apparatus also includes rollers to join the first signature portion and the second signature portion.

One disclosed example method includes receiving a book at a portion of a binding line. The book includes signatures coupled by a fastener. The fastener separates a first signature portion from a second signature portion of a first signature. The example method also includes dispensing adhesive to at least one of on or adjacent the fastener to couple the first signature portion and the second signature portion along a first fold adjacent the fastener.

In some examples, the example method also includes folding to form a second fold on the first signature portion and a third fold on the second signature portion, and at least a portion of the fastener is to be disposed between the second fold and the third fold. In some examples, the second fold is to be brought into engagement with the third fold.

In some examples, the example method also includes detecting a presence or an absence of a second fastener of a second book, and dispensing adhesive to the second book based on a detected presence of a second fastener. In some examples, the example method also includes detecting at least one of a rate of travel or a distance of travel of the book on the binding line. In some examples, the dispensing adhesive of the example method also includes dispensing adhesive between a first distance from a leading edge of the book to a second distance from a trailing edge of the book. In some examples, the example method also includes adjusting at least one of a rate that the adhesive is dispensed, a width of the dispensed adhesive, or an amount of adhesive that is dispensed. In some examples, the example method also includes atomizing the dispensed adhesive.

Another described example apparatus includes signatures coupled together with a fastener. The fastener separates a first signature portion of a first signature from a second signature portion of the first signature. The example apparatus also includes adhesive coupling the first signature portion and the second signature portion adjacent a first fold and the fastener. The example apparatus also includes a second fold on the first signature portion and a third fold on the second signature portion. The second fold is to be in engagement with the third fold and at least a portion of the fastener is positioned between the first fold, the second fold and the third fold.

In other examples, a ratio of a first length from the first fold to the second and third folds to a second length from the second and third folds to an end of the signatures is approximately 0.10 to 0.30.

Turning now to the figures, FIG. 1 is a schematic illustration of an example binding line 100 that can be used to produce the example books disclosed herein. As illustrated in FIG. 1, in some examples, the example binding line 100 includes signature feeders 102 that are positioned near or at a conveyor (e.g., a conveyor chain) 104. The binding line 100 may include any number of the signature feeders 102, which may be in any suitable position relative to the conveyor 104. In the illustrated example, the signature feeders 102 are coupled to hoppers 106 that hold at least one signature to be fed to the signature feeders 102. Additionally, in the illustrated example, at least one of the hoppers 106 is coupled to at least one additional hopper 108 positioned substantially perpendicular to, parallel to, behind, or otherwise proximate to at least one of the hoppers 106. As set forth herein, substantially perpendicular means within about 25 degrees of perpendicular and substantially parallel means within about 25 degrees of parallel. If the additional hopper 108 is coupled to at least one of the hoppers 106 (e.g., two additional hoppers 108 are coupled to the hopper 106), each of the signature feeders 102 may be able to feed different signatures onto the conveyor when, for example, the first additional hopper 108 has signatures associated with a first book and the second additional hopper 108 has signatures associated with a second book. The signatures may be any size such as, for example, large formats or table-sized books.

In this example, the binding line 100 includes a controller 110 that is communicatively coupled to the signature feeders 102 and may be communicatively coupled to any other device within the example binding line 100. In some examples, the controller 110 is a Nordson™ EPC-30 or any other suitable controller. In operation, the conveyor 104 moves pockets 112 in a direction generally indicated by arrow 114 in front of the signature feeders 102. As the pockets 112 move in proximity to the front of the signature feeders 102, the respective signature feeders 102 may deliver a signature onto one or more of the pockets 112 to form a book (e.g., a flier, a magazine, a pamphlet, etc.). As the pockets 112 move in front of the different signature feeders 102, the signatures may be stacked on top of one another, the last of which may correspond to a front and/or rear cover of the book.

In some examples, some of the pockets 112 may be associated with a first book and some of the other pockets 112 may be associated with a second book. As such, signatures that correspond to the first book are delivered to a first pocket 112 and signatures that correspond to a second book are delivered to a second pocket 112. In some examples, the first book may be a first size (e.g., 100 pages, a first spine length, etc.) and the second book may be a second size (e.g., 200 pages, a second spine length, etc.). Furthermore, a spine length of the first book may be different than a spine length of the second book.

In the illustrated example, the binding line 100 includes a stapler 118 that staples and binds the signatures together to form a book having a saddle stitch. In this example, the stapler 118 is positioned between the signature feeders 102 and a staple sensor 120. However, in other examples, the stapler 118 may be in a different position. While the stapler 118 is described herein as producing a saddle stitch book, the stapler 118 may additionally or alternatively create any type of book binding such as, square backs, a side stitch, etc.

In some examples, the staple sensor 120 detects a presence of a staple and/or whether a correct number of staples are present. If a staple and/or the correct number of staples are detected, in the illustrated example, the controller 110 causes an adhesive station 121 to dispense adhesive to the interior of the book as the book moves on the conveyor 104 through the adhesive station 121. For example, the adhesive station 121 dispenses adhesive adjacent a staple(s) in the book and couples two portions of a center signature together before the books move to a conveyor 124. Coupling the two portions of the signature positions and/or encapsulates the staples within the adhesive portion and forms opposing folds on the signature that are adjacent to one another. If a staple is not detected, the controller 110 may prevent or not cause the adhesive station 121 to dispense adhesive. A reference database 125 accessed by the controller 110 may include parameters such as what books are being produced, necessary signatures to produce a particular book, rates of travel of the conveyors 104, 124, quantity of books to be produced, length of each book, a production sequence, whether books should have staples and/or adhesive applied, etc.

In the illustrated example, a detected absence of a staple may result in the book being diverted away from the adhesive station 121 and onto a diverter 122 that bypasses the adhesive station 121 and leads to the conveyor 124. Diverting the book in such a manner may be advantageous when unstapled books are being produced with stapled books on the binding line 100. If the book is not diverted to the diverter 122 or if the diverter 122 is not present, the book moves to a rejector 127 in which the book may be rejected into a reject gate 129 for the incorrect number of staples and/or unintended missing staples.

After the books pass the adhesive station 121 and the rejector 127, in the illustrated example, the conveyor 124 moves the books to one or more trimmers 126. In examples in which different size books are simultaneously produced and/or during the same production run, the trimmer 126 may be a variable trimmer and/or the trimmers 126 may include corresponding conveyors and diverters to trim the different books.

In the illustrated example, after the books are trimmed, the conveyor 104 leads to additional rollers and/or opposing rollers 128 that compress the respective books to couple portions of the central signature at least partially together, via the adhesive, to enclose and/or prevent the exposure of the staple ends. In this example, the books then move toward a stacker 130, which sorts and/or packages the different books. The example binding line 100 may produce any number of books (e.g., a first book, a second book, a third book, a fourth book, etc.) in the same production run. In the illustrated example, after the different books are packaged, the packages may move along the conveyor 124 to a palletizer 132, which places the different packages onto pallets for shipment.

Figure 2:
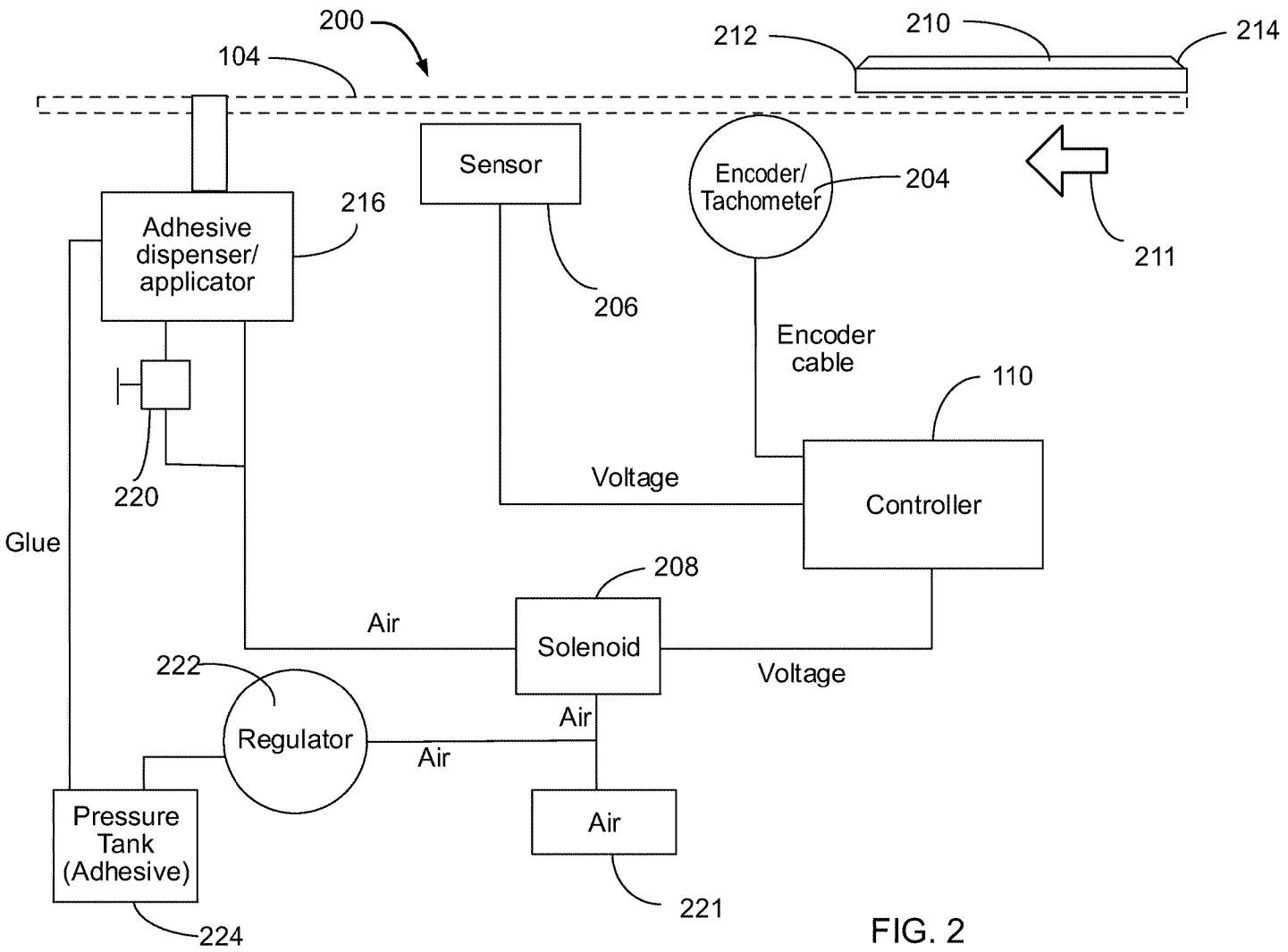
FIG. 2 is a schematic illustration of an example adhesive station that may be incorporated into the example binding line of FIG. 1.

FIG. 2 is a schematic illustration of an example adhesive station 200 that may be incorporated into the example binding line 100 of FIG. 1. In the illustrated example, the controller 110 is communicatively coupled to an encoder (e.g., tachometer) 204, a sensor 206 and a solenoid 208. In some examples, the encoder 204 is used to detect the rate of travel and/or the distance of travel of the conveyor 104, the sensor 206 is used to identify when a leading edge 212 and/or a trailing edge 214 of a book 210 moves past a location on the binding line 100 and the solenoid 208 is associated with operating an adhesive dispenser 216.

In operation, as the book 210 moves in the direction generally indicated by arrow 211, the encoder 204 determines and/or transmits a rate of travel and/or a distance of travel of the conveyor 104 to the controller 110, based on, for example, rotation of the encoder 204. In some examples, to determine when the book 210 is to be positioned adjacent the adhesive dispenser 216, the sensor 206 signals the controller 110 that the respective edges 212, 214 have moved past the sensor 206 and the positional information from the sensor 206 is used to estimate when the book 210 will move over the adhesive dispenser 216. In some examples, the sensor 206 may be approximately two feet in front of the adhesive dispenser 216 or any other appropriate distance.

In some examples, the controller 110 determines when to cause the adhesive dispenser 216 to dispense adhesive to the interior of stapled book 210 based on when the sensor 206 identified the leading and/or trailing edges 212, 214, the rate of travel and/or the distance of travel of the conveyor 104. In other examples, if the encoder 204 is not included, the controller 110 determines when to cause the adhesive dispenser 216 to dispense adhesive to the interior of the book 210 based on a pre-defined speed of the conveyor 104. Additionally or alternatively, to determine when to cause the adhesive dispenser 216 to dispense adhesive to the interior of the book 210, the controller 110 may use the sensor 206 output associated with the leading edge 212, a length of the book 210 stored in the database 125, the rate of travel of the conveyor 104 and/or the distance of travel of the conveyor 104.

As the book 210 travels over the adhesive dispenser 216, the controller 110 actuates the solenoid 208 causing the adhesive dispenser 216 to dispense adhesive along the length of the book 210 (e.g., between the leading edge 212 and the trailing edge 214). Alternatively, the adhesive dispenser 216 may dispense adhesive to the book 210 between a first distance from the leading edge 212 to a second distance from the trailing edge 214. In some examples, the adhesive dispenser 216 has a valve (e.g., an adjustable petcock) 220 to atomize the adhesive and/or adjust the width of the adhesive spray dispensed by the adhesive dispenser 216. To supply adhesive to the adhesive dispenser 216, an air source 221 provides air to pressurize an adhesive filled pressure tank 224 through a regulator 222.

In examples in which the book is not a saddle stitch book, is defective and/or doesn't have the proper number of staples, the adhesive station 200 may not dispense adhesive to the book 210 as the book passes the adhesive dispenser 216. For example, in some such examples, the staple sensor 120 (FIG. 1) may signal the controller 110 that an absence of staples have been detected in the unstapled book and accordingly, the controller 110 may prevent (e.g., hold) and/or not cause the adhesive dispenser 216 to dispense adhesive to the unstapled book as the book passes over the adhesive dispenser 216. As discussed above in connection with FIG. 1, the adhesive station 200 may be bypassed altogether by diverting the unstapled book to the diverter 122 (FIG. 1). Additionally or alternatively, the controller 110 may use the data (e.g., book produced, book type, etc.) from the database 125 to instruct the adhesive dispenser 216 accordingly.

Figure 3:
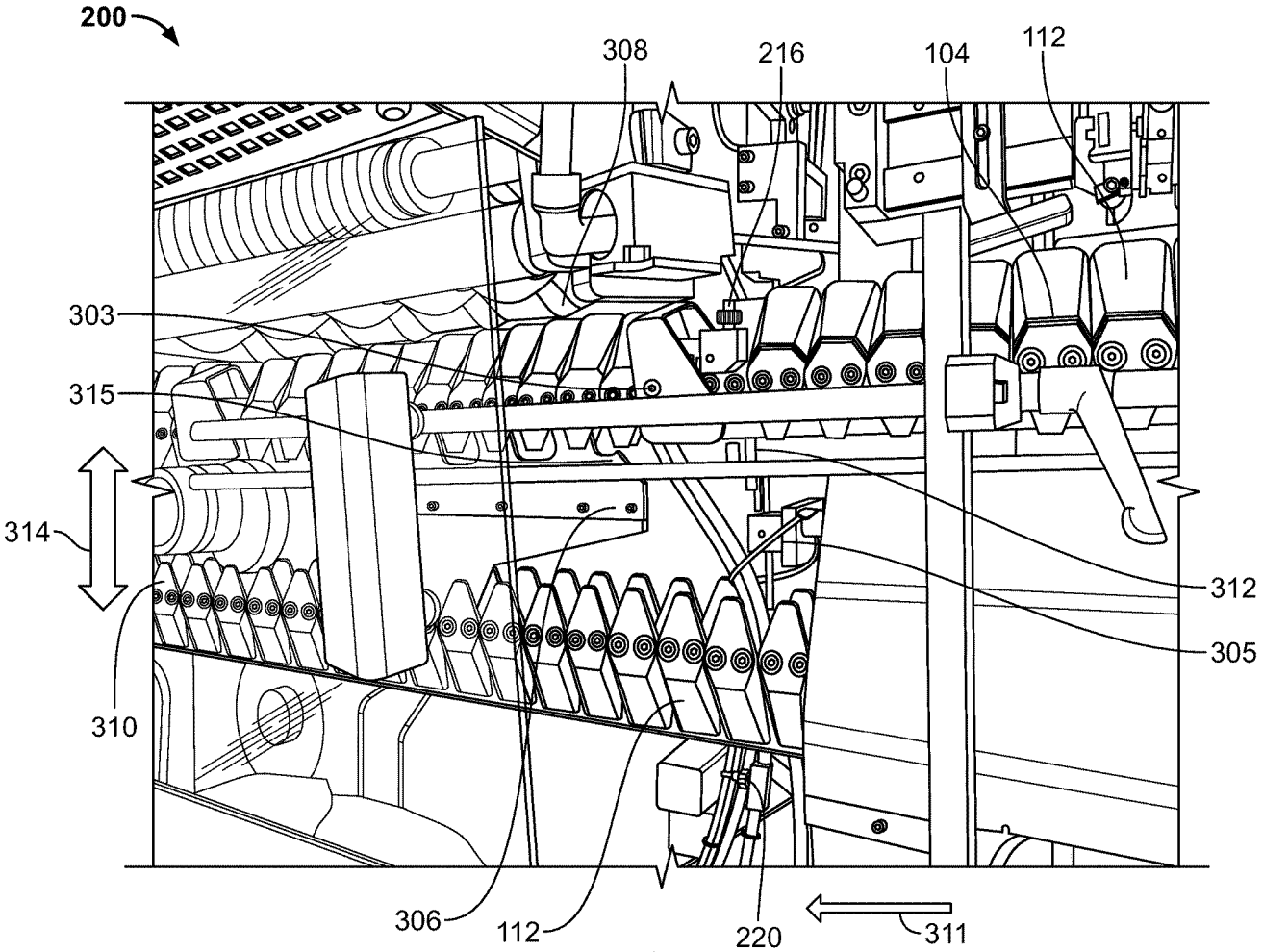
FIG. 3 is a side view of a portion of the example adhesive station of FIG. 2.

FIG. 3 is a side view of a portion of the example adhesive station 200 of FIG. 2. In the illustrated example, the adhesive station 200 includes guides 303, the adhesive dispenser 216, the pockets 112, a mounting block 305, the valve 220, a tucker blade 306, a second conveyor 308 and a return 310. An arrow 311 generally depicts the direction of travel for the conveyor 104. In the illustrated example, the guides 303 align the signatures relative to the conveyor 104 as the signatures move along the conveyor 104. In the illustrated example, the adhesive dispenser 216 is located near the center of the conveyor 104 between the pockets 112 to dispense adhesive to the interior of the books as the books travel over the adhesive dispenser 216. In some examples, the vertical position of the dispenser 216 is adjustable relative to the pockets 112 and the books via the mounting block 305 by, for example, the dispenser 216 being threadably engaged to a threaded rod 312. Additionally or alternatively, the adhesive spray width may also be adjusted via the valve 220.

After the dispenser 216 dispenses adhesive to books moving along the conveyor 104, the books are pushed by the tucker blade 306 into the second conveyor 308. In some examples, the tucker blade 306 moves in a reciprocating motion as generally indicated by arrow 314. In some examples, the books are then placed onto the conveyor 124 for trimming. Placement of the books onto the second conveyor 308 via the tucker blade 306 and/or use of the additional rollers 128 may ensure proper adhesive coupling. The tucker blade 306 may have a contoured leading edge 315 to substantially prevent excessive adhesive from accumulating on the tucker blade 306. The conveyor 104 includes the return 310 to cycle the conveyor 104 to the beginning of the binding line 100.

Figure 4:
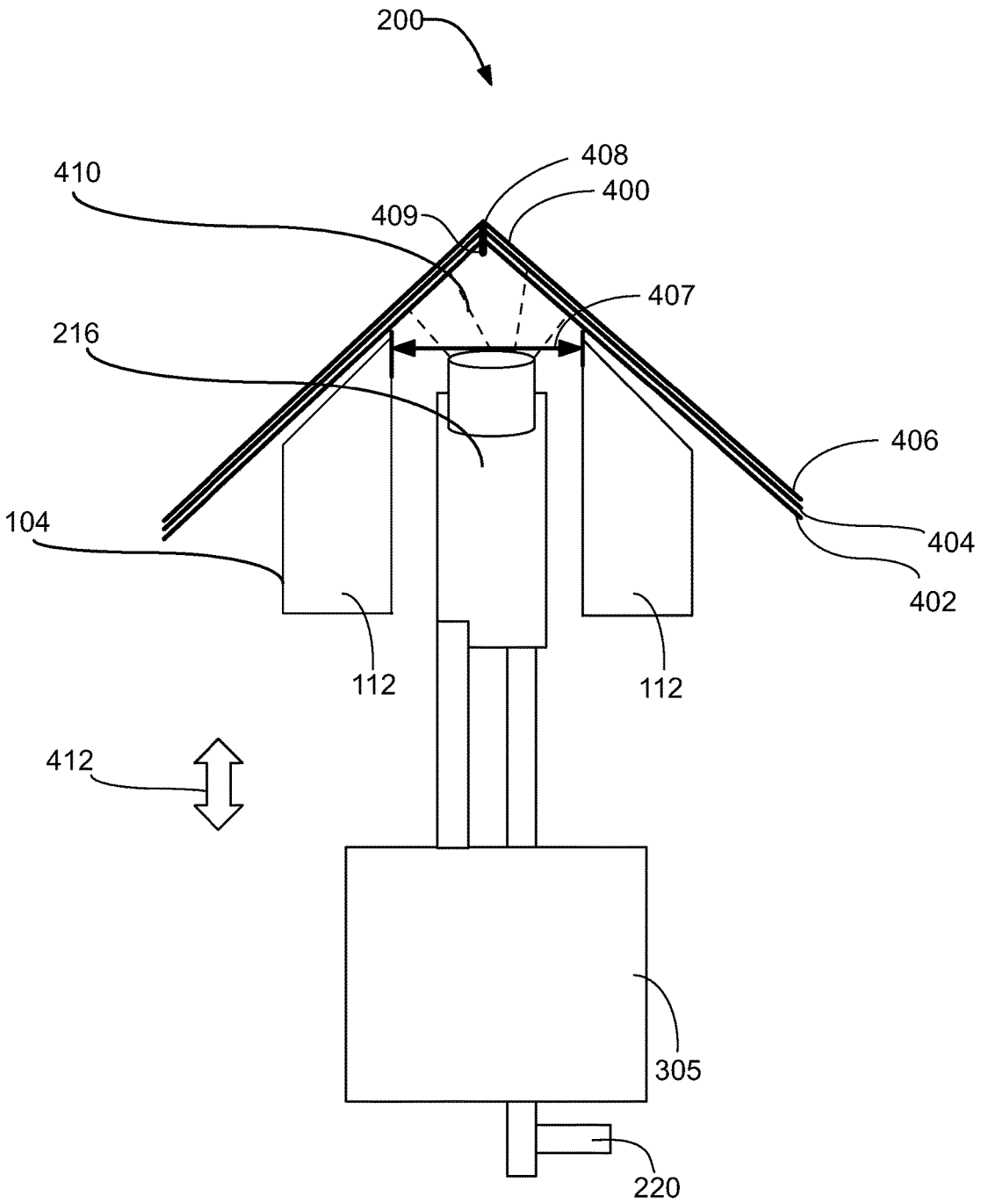
FIG. 4 is a view along the direction of travel of the conveyor depicting an example stapled book at the example adhesive station of FIGS. 2 and 3.

FIG. 4 is a view along the direction of travel of the conveyor 104 depicting an example stapled book 400 on the conveyor 104 of the example adhesive station 200 of FIGS. 2 and 3. The book 400 includes first, second and third signatures 402, 404, 406, respectively, which are coupled together with a staple and/or a fastener 408. While the book 400 includes three signatures 402, 404, 406, the book 400 may include any other number of signatures (e.g., 2, 4, 5, etc.).

As described above, the signatures 402, 404, 406 are stacked on one or more of the pockets 112 where the first signature 402 is in contact with the pocket 112 and a space 407 is provided between portions of the pocket 112 such that adhesive dispensed from the adhesive dispenser 216 is receivable adjacent the fastener 408 along an interior fold 409 of the book 400. In the illustrated example, the dispenser 216 is located near the center of the pockets 112 and a placement height of the adhesive dispenser 216 is adjustable (e.g., manually, automatically) relative to the mounting block 305 generally in the direction of arrow 412.

In this example, as the stapled book 400 travels over the adhesive dispenser 216, the controller 110 causes the adhesive dispenser 216 to dispense adhesive in the form of an atomized spray 410. In the illustrated example, a width of the spray 410 is adjustable by the valve 220. While an atomized spray is depicted in this example, the adhesive application may be applied through a variety of methods including dispensing liquid adhesive directly through a nozzle, for example.

Figure 5:
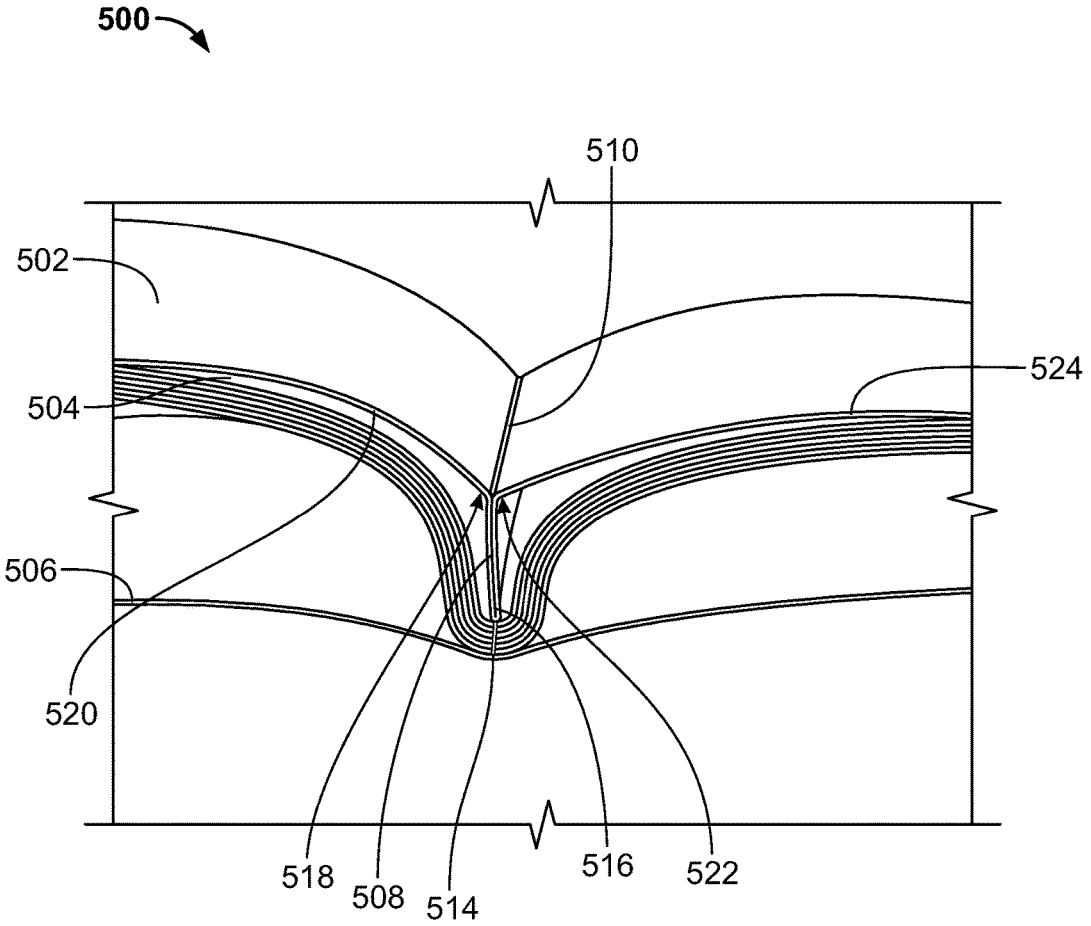
FIG. 5 illustrates an example book produced in accordance with the teachings of this disclosure.

FIG. 5 illustrates an example book 500 produced in accordance with the teachings of this disclosure. The book 500 includes first, second and third signatures 502, 504, 506, respectively, where the first signature 502 has adhesive 508 coupling a center region 510 of the first signature 502. The coupled region 510 substantially prevents interior ends of a staple 514 from being exposed even when the book 500 is opened at its center. The staple 514 is located proximate a first fold 516 and the adhesive 504 enables the formation of a second fold 518 on a first signature portion 520 and a third fold 522 on a second signature portion 524 where the portions 520, 524 make up the first signature 502. In this example, the second fold 518 and the third fold 522 are immediately adjacent one another and the staple 514 is located between the first fold 516 and the second and third folds 518, 522. A ratio of a first length from the first fold 516 to the second and third folds 518, 522 to a second length from the second and third folds 518, 522 to an end of the signatures may be approximately 0.10 to 0.30 or any other appropriate ratio. The book 500 may have a total of two staples or any other appropriate number of staples based on length, amount of pages, etc.

Figure 6:
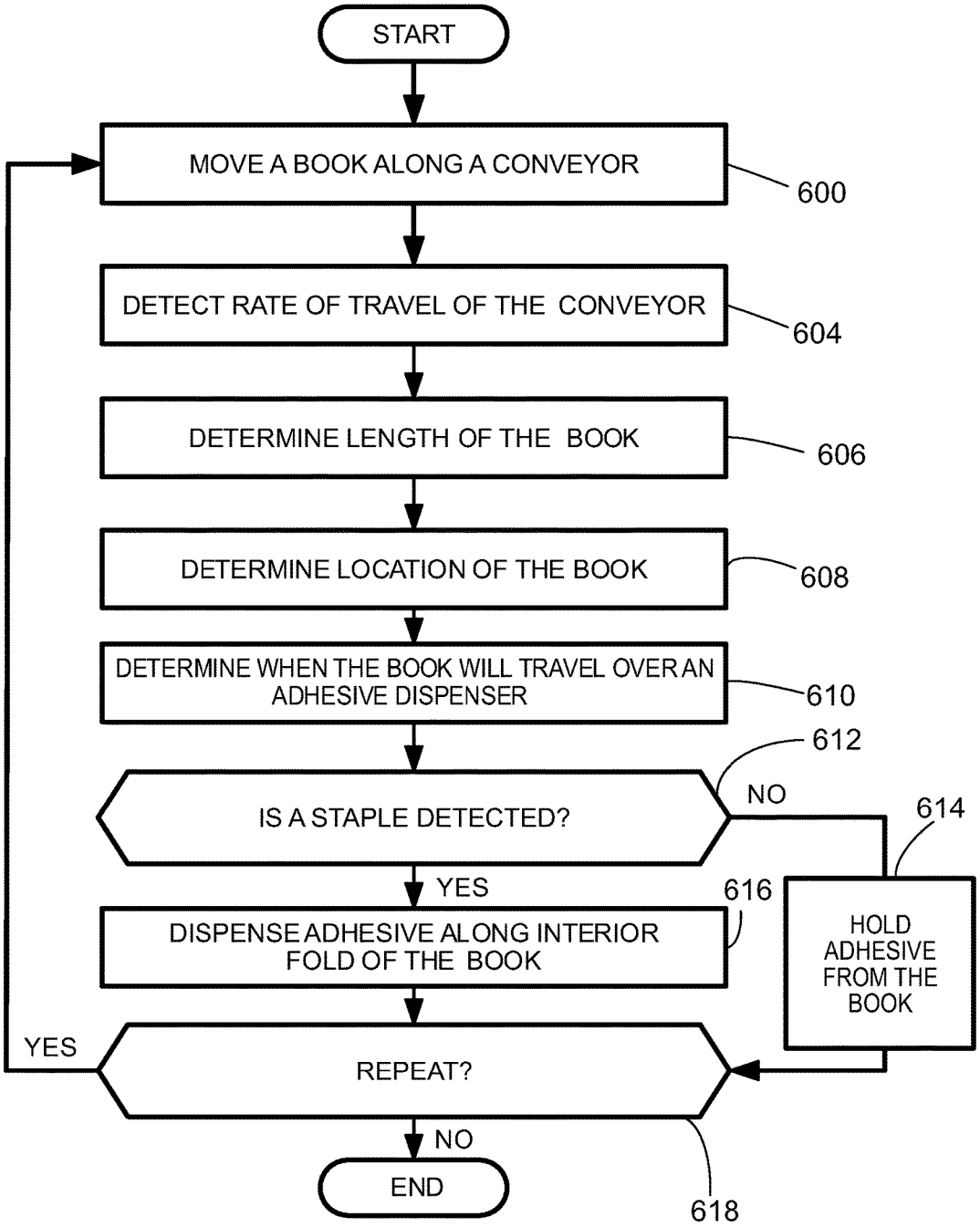
FIG. 6 is a flowchart representative of example machine readable instructions for implementing the example adhesive stations of FIGS. 1-4.

FIG. 6 illustrates a flowchart representative of example machine readable instructions for implementing the example adhesive stations 121, 200 of FIGS. 1-4. In this example, the machine readable instructions comprise a program for execution by a processor such as the processor 712 shown in the example processor platform 700 discussed below in connection with FIG. 7. The program may be embodied in software stored on a tangible computer readable storage medium such as a CD-ROM, a floppy disk, a hard drive, a digital versatile disk (DVD), a Blu-ray disk, or a memory associated with the processor 712, but the entire program and/or parts thereof could alternatively be executed by a device other than the processor 712 and/or embodied in firmware or dedicated hardware. Further, although the example program is described with reference to the flowchart illustrated in FIG. 6, many other methods of implementing the example adhesive stations 121, 200 may alternatively be used. For example, the order of execution of the blocks may be changed, and/or some of the blocks described may be changed, eliminated, or combined.

As mentioned above, the example process of FIG. 6 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and to exclude transmission media. As used herein, "tangible computer readable storage medium" and "tangible machine readable storage medium" are used interchangeably. Additionally or alternatively, the example processes of FIG. 6 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

The example process of FIG. 6 is described below in connection with the example structures described in connection with FIGS. 1-4. The example process of FIG. 6 begins at block 600 where an order of books is prepared or created by, for example, the controller 110 of FIGS. 1 and 2 (e.g., different titles, same titles, an order to qualify for a lower postage presort level) and signatures are stapled together to form books, which are moved along the conveyor 104 (block 600). In some examples, the controller 110 controls when the signature feeders 102 deliver signatures to the pockets 112 moving along the conveyor 104 and the encoder 204 detects a rate and/or a distance of travel of the conveyor 104 (block 604). In some examples, the controller 110 determines a length of each book by combining and/or using data obtained from the sensor 206 and/or the measured rate or distance of travel of the conveyor 104 measured at the encoder 204 (block 606). To determine when and/or for how long to dispense adhesive to a book, in some examples, the controller 110 determines a location of the book (block 608) and when the book will travel over the adhesive dispenser 216 (block 610) based on the rate of travel and/or the distance of travel of the conveyor 104, and data obtained from the sensor 206. In some examples, the bindery line 100 may simultaneously run production of both stapled and unstapled books. Thus, the binding line 100 may determine whether to dispense adhesive. Accordingly, in the illustrated examples, the staple sensor 120 is used to detect the presence/absence of a staple (block 612) and, if an absence of the staple is detected by the sensor 206, the controller 110 will cause the adhesive dispenser 216 to hold adhesive from the book (block 614). Alternatively, if an absence of a staple is detected (block 612), the unstapled book may be diverted away from the adhesive dispenser 216 for trimming. If a staple is detected (block 612), the controller 110 will cause the adhesive dispenser 216 to dispense adhesive to the interior fold of the book as the book travels over the adhesive dispenser 216 (block 616). At block 618, the process determines whether to repeat the process (block 618). In some examples, the controller 110 may be programmed, or may by default, to cause the adhesive dispenser 216 to dispense adhesive to only a portion of the length of the book (e.g., dispense adhesive to the book from a first distance from a leading edge to a second distance from a trailing edge).

Figure 7:
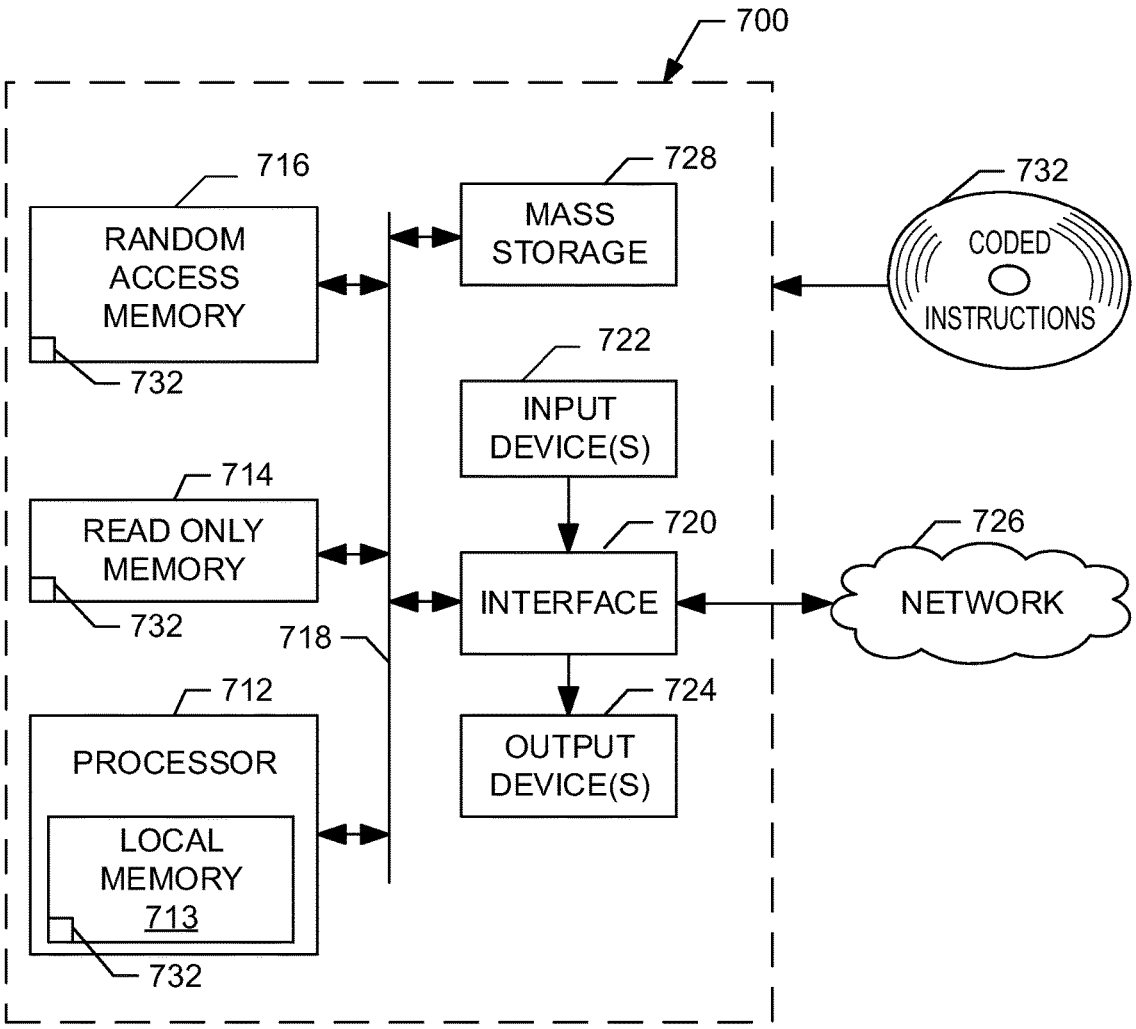
FIG. 7 is a block diagram of an example processor platform capable of executing the instructions of FIG. 6 to implement the example adhesive stations of FIGS. 1-4.

FIG. 7 is a block diagram of an example processor platform 700 capable of executing the instructions of FIG. 6 to implement the controller 110 and/or the adhesive stations 121, 200 of FIGS. 1-4. The processor platform 700 can be, for example, a server, a personal computer, a mobile device (e.g., a cell phone, a smart phone, a tablet such as an iPad™), a personal digital assistant (PDA), an Internet appliance, a DVD player, a CD player, a digital video recorder, a Blu-ray player, a gaming console, a personal video recorder, a set top box, or any other type of computing device.

The processor platform 700 of the illustrated example includes a processor 712. The processor 712 of the illustrated example is hardware. For example, the processor 712 can be implemented by one or more integrated circuits, logic circuits, microprocessors or controllers from any desired family or manufacturer.

The processor 712 of the illustrated example includes a local memory 713 (e.g., a cache). The processor 712 of the illustrated example is in communication with a main memory including a volatile memory 714 and a non-volatile memory 716 via a bus 718. The volatile memory 714 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 716 may be implemented by flash memory and/or any other desired type of memory device. Access to the main memory 714, 716 is controlled by a memory controller.

The processor platform 700 of the illustrated example also includes an interface circuit 720. The interface circuit 720 may be implemented by any type of interface standard, such as an Ethernet interface, a universal serial bus (USB), and/or a PCI express interface.

In the illustrated example, one or more input devices 722 are connected to the interface circuit 720. The input device(s) 722 permit a user to enter data and commands into the processor 712. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 724 are also connected to the interface circuit 720 of the illustrated example. The output devices 724 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 720 of the illustrated example, thus, typically includes a graphics driver card.

The interface circuit 720 of the illustrated example also includes a communication device such as a transmitter, a receiver, a transceiver, a modem and/or network interface card to facilitate exchange of data with external machines (e.g., computing devices of any kind) via a network 726 (e.g., an Ethernet connection, a digital subscriber line (DSL), a telephone line, coaxial cable, a cellular telephone system, etc.).

The processor platform 700 of the illustrated example also includes one or more mass storage devices 728 for storing software and/or data. Examples of such mass storage devices 728 include floppy disk drives, hard drive disks, compact disk drives, Blu-ray disk drives, RAID systems, and digital versatile disk (DVD) drives.

The coded instructions 732 of FIG. 6 may be stored in the mass storage device 728, in the volatile memory 714, in the non-volatile memory 716, and/or on a removable tangible computer readable storage medium such as a CD or DVD.

From the foregoing, it will be appreciated that the above disclosed methods, apparatus and articles of manufacture allow stapled books in which staples ends are substantially non-exposed and/or non-accessible.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus, comprising:

a sensor to detect a position of a book being produced on a binding line, the book comprising signatures coupled by a fastener that extends through the signatures, the fastener to separate a first signature portion from a second signature portion of a first signature;

an adhesive dispenser to dispense adhesive along a first fold adjacent the fastener to couple the first and second signature portions along the first fold to prevent access to a portion of the fastener;

a folder to form a second fold on the first signature portion and a third fold on the second signature portion, the portion of the fastener disposed between the second fold and the third fold, wherein the adhesive is disposed between the second fold and the third fold; and a controller programmed with instructions to cause the adhesive dispenser to dispense adhesive based on the position of the book detected by the sensor.

2. The apparatus as defined in claim 1, wherein the second fold is to be brought into engagement with the third fold.

3. The apparatus as defined in claim 1, further comprising:

a conveyor to transport the book; and an encoder programmed with instructions to measure at least one of a rate of travel of the conveyor or a distance of travel of the conveyor and to convey at least one of the rate of travel or the distance of travel to the controller.

4. The apparatus as defined in claim 3, wherein the controller is to determine the position of the book based on at least one of the rate of travel or the distance of travel.

5. The apparatus as defined in claim 1, further comprising a second sensor to detect a presence or an absence of a fastener in a second book, wherein the controller is programmed with instructions to hold adhesive from the second book based on a detected absence.

6. The apparatus as defined in claim 1, wherein the first sensor is to detect a first leading edge and a first trailing edge of a first book and a second leading edge and a second trailing edge of a second book, wherein a first distance between the first leading and trailing edges is different from a second distance between the second leading and trailing edges.

7. The apparatus as defined in claim 6, wherein the controller is programmed with instructions to cause the adhesive dispenser to dispense adhesive to the first book and the second book based on the first and second distances and the respective first and second leading and trailing edges.

8. The apparatus as defined in claim 1, wherein the adhesive dispenser is to atomize the dispensed adhesive.

9. The apparatus as defined in claim 1, wherein the first sensor is to detect a leading edge and a trailing edge of the book and the controller is programmed with instructions to cause the adhesive dispenser to dispense adhesive between the leading edge and the trailing edge.

10. The apparatus as defined in claim 9, wherein the controller is programmed with instructions to dispense between a first distance from the leading edge and a second distance from the trailing edge to prevent the adhesive from flowing out of the book when the book passes through rollers after the book receives the adhesive.

11. The apparatus as defined in claim 1, wherein the adhesive dispenser comprises an adjuster to change at least one of a rate of adhesive dispensed, a width of the adhesive dispensed, or an amount of adhesive dispensed.

12. The apparatus as defined in claim 1, further comprising rollers to join the first signature portion and the second signature portion.

13. The apparatus as defined in claim 1, further comprising:

a second sensor to detect a presence or an absence of a fastener in a second book; and a diverter programmed with instructions to move the second book away from the adhesive dispenser.

14. The apparatus as defined in claim 1, further comprising a reciprocating blade to place the book onto a conveyor after the adhesive has been dispensed.

15. The apparatus as defined in claim 1, wherein the first signature is an innermost signature of the book.

16. The apparatus as defined in claim 1, wherein the fastener includes a staple, and wherein the portion includes staple ends.

17. The apparatus as defined in claim 2, wherein the adhesive is disposed between the first fold and the engagement of the second fold and the third fold.

18. The apparatus as defined in claim 12, wherein the rollers are to form the first fold.

19. A book, comprising:

signatures coupled together with a fastener, the fastener to extend through the signatures and separate a first signature portion of a first signature from a second signature portion of the first signature;

adhesive coupling the first signature portion and the second signature portion adjacent a first fold that is positioned proximate the fastener, wherein coupling the first and second portions is to prevent access to ends of the fastener;

a second fold on the first signature portion; and a third fold on the second signature portion, the second fold in engagement with the third fold, and at least a portion of the fastener positioned between the first fold, the second fold and the third fold.

20. The book as defined in claim 19, wherein a ratio of a first length from the first fold to the second and third folds to a second length from the second and third folds to an end of the signatures is approximately 0.10 to 0.30.

21. The book as defined in claim 19, wherein the first fold is adjacent a fourth fold of a second signature.

22. The book as defined in claim 21, wherein the fastener passes through the first and fourth folds.

* * * * *